United States Patent [19]

Bielfeldt

[11] Patent Number: 5,019,206

[45] Date of Patent: May 28, 1991

[54] APPARATUS FOR THE INSERTION OF LAMINATED PACKS INTO HOT PRESSES

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 373,063

[22] Filed: Jun. 28, 1989

[51] Int. Cl.[5] ..... B30B 15/30

[52] U.S. Cl. ..... 156/538; 100/215; 100/295; 156/583.1; 198/847; 271/194

[58] Field of Search ..... 156/583.1, 581; 100/215, 218, 295; 198/799, 817, 846, 847; 414/278, 283; 271/264, 266, 268, 204, 206, 107, 194

[56] References Cited

U.S. PATENT DOCUMENTS

| | | | |
|---|---|---|---|
| 4,242,092 | 12/1980 | Glover | 8/472 |
| 4,253,891 | 3/1981 | Brussel | 156/60 |
| 4,287,983 | 9/1981 | Bronsveld | 198/817 |
| 4,348,252 | 9/1982 | Knoop et al. | 156/538 |
| 4,424,092 | 1/1984 | Salenz | 156/391 |
| 4,533,040 | 8/1985 | Howerton | 198/847 |
| 4,558,492 | 12/1985 | Hite et al. | 198/847 X |
| 4,637,850 | 1/1987 | Suzuki et al. | 100/215 X |

FOREIGN PATENT DOCUMENTS

| | | | |
|---|---|---|---|
| 1911764 | 9/1970 | Fed. Rep. of Germany . | |
| 2203751 | 8/1973 | Fed. Rep. of Germany | 100/215 |
| 2928231 | 7/1979 | Fed. Rep. of Germany . | |

*Primary Examiner*—David A. Simmons
*Attorney, Agent, or Firm*—Foley & Lardner

[57] ABSTRACT

A press apparatus is provided wherein the vacuum suction lifters, due to a swing-in movement, can be moved more quickly into the lifting position for attaching the finish-coated panel by suction and, due to the telescopic extension, can be accurately set to the statically best longitudinal positions for panels of various widths. By a positioning and drive device, rolling belt trays used according to the invention can be moved accurately at various positions into the press area in conformity with different panel widths. As a result of the construction members and measures according to the invention, the movable parts have been further reduced in weight, thereby permitting faster movements. Furthermore, this results in higher flexibility and greater operational readiness of the short-cycle installation when changing over to other panel widths. The higher flexibility and better operational readiness, as well as longer service times of the installation, are also aided by the advantageous design of the conveying belts having a mechanical hinge connection for rapid repacement of any damaged belts. The convenient covering of the hinges with plastic is intended to help to protect the deflection pulleys in the inlet and outlet area of the press and also to protect the films during transport on the conveying belts.

12 Claims, 5 Drawing Sheets

APPARATUS FOR THE INSERTION OF LAMINATED PACKS INTO HOT PRESSES

BACKGROUND OF THE INVENTION

1. Field of the Invention

The present invention relates to apparatuses for pressing laminated packs, and more particularly, to an apparatus for inserting a laminated pack into a hot press, pressing the laminated pack and removing the pack from the hot press.

2. Discussion of the Related Art

German Offenlegungsschrift 2,928,231 discloses a typical apparatus for pressing laminating packs. In this known apparatus, the laminated pack is seized by two supporting devices, which are moved from the longitudinal sides of the press into the press area. The pack is then moved into the daylight opening and held at a distance above the bottom press plate until the supporting devices have been moved laterally out of the press area. In the process, a panel laid down beforehand by vacuum suction lifters is moved out at an emptying side of the press by the supporting devices, which also serve as a conveying apparatus. To deposit the panel onto the supporting devices, it is first necessary to move the vacuum suction lifters into position and lift the panel.

The supporting devices and conveying apparatuses each comprise an endless conveying belt guided around the press table and are arranged in the press frame so as to be movable into and out of the press area at right angles to the feed direction. Since in such short-cycle installations for coating or improving chipboard panels the manipulating times for inserting and removing the product to be pressed are far greater compared with the sheer press time, industry demands that these manipulating times be shortened in order to lower the production costs of an improved panel. Here, in the case of the mass article to be manufactured, even the smallest improvements in the apparatus can result in price advantages for the end product. The known apparatus has the disadvantage that very long conveying belts and a plurality of heavy rack-and-pinion drives are required to displace the drive and deflection pulleys.

SUMMARY OF THE INVENTION

The object of the invention is to provide an apparatus wherein the manipulating time for a feed and emptying operation in short-cycle installations can be further reduced.

A further object of the invention is to provide a press apparatus having an improved vacuum lifter assembly.

Another object of the invention is to provide a press apparatus having improved conveyor belts.

The foregoing and additional objects are attained by providing an apparatus wherein the vacuum suction lifters, due to a swing-in movement, can be moved more quickly into the lifting position for attaching the finish-coated panel by suction and, due to the telescopic extension, can be accurately set to the statically best longitudinal positions for panels of various widths. By a positioning and drive device, rolling belt trays used according to the invention can be moved accurately at various positions into the press area in conformity with different panel widths. As a result of the construction members and measures according to the invention, the movable parts have been further reduced in weight, thereby permitting faster movements. Furthermore, this results in higher flexibility and greater operational readiness of the short-cycle installation when changing over to other panel widths. The higher flexibility and better operational readiness, as well as longer service times of the installation, are also aided by the advantageous design of the conveying belts having a mechanical hinge connection for rapid replacement of any damaged belts. The convenient covering of the hinges with plastic is intended to help to protect the deflection pulleys in the inlet and outlet area of the press and also to protect the films during transport on the conveying belts.

To improve the guidance of the conveying belts in the rolling belt trays—particularly in longer presses, i.e. greater than 5 m—conveying belts are provided which have ribs vulcanized in place in the longitudinal center.

The apparatus according to the present invention is less susceptible to problems, since the movable parts are of especially simple construction and permit high speeds with large braking and acceleration forces.

Further objects and advantages of the present invention will become apparent in the specification and drawings which follow.

DETAILED DESCRIPTION OF THE PREFERRED EMBODIMENTS

Figure 1:
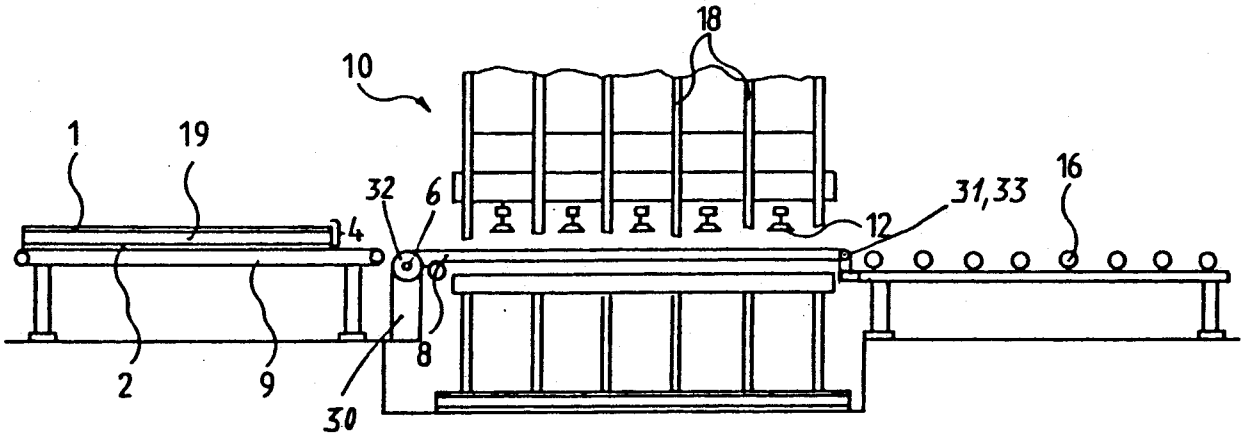
FIG. 1 is a schematic side view of a shortcycle installation of the apparatus according to the present invention.

The present invention contemplates an apparatus, shown in FIGS. 1 to 9, for inserting, pressing and removing a laminated product 4 to be pressed. The laminated product 4 comprises a top and bottom coating material 1 and 2 (FIG. 1), such as curable synthetic-resin films, synthetic-resin-impregnated papers, etc., and a coating base 19 of chipboard panels or fiberboard panels. The laminated pack 4 is inserted between heating plates 13 and 17 of a hot press 10 by means of two rolling belt trays 8, which can be moved into and out of the press area at right angles to the feed direction of the press and receive and support the product 4 to be pressed only at the longitudinal margins thereof. In the process, the rolling belt trays 8 are displaced or pulled on a splined shaft 6 by a positioning and drive device 30.

Serving as a drive in a preferred embodiment is an electric motor 20 (FIG. 9) which, by means of a cable or chain line 22, accurately positions the rolling belt trays 8 at holding points during the press cycle in the press frame 18 and at the predetermined longitudinal points in the press area. The rolling belt trays 8 have twin guidance and support on the splined shaft 6 and, with traveling rollers 14, in a guide rail 21. At the outlet or after the heating plate 13, the deflection pulleys 33 of the two rolling belt trays 8 are displaceably arranged on a common guide shaft 31. In the case of longer press lengths, provision is made for single or multiple support of the rotating conveying belts 15 within the length of the rolling belt trays by supporting rollers (not shown), which can be pushed into and out of the press area and are guided on rack-and-pinion drives.

Figure 2:
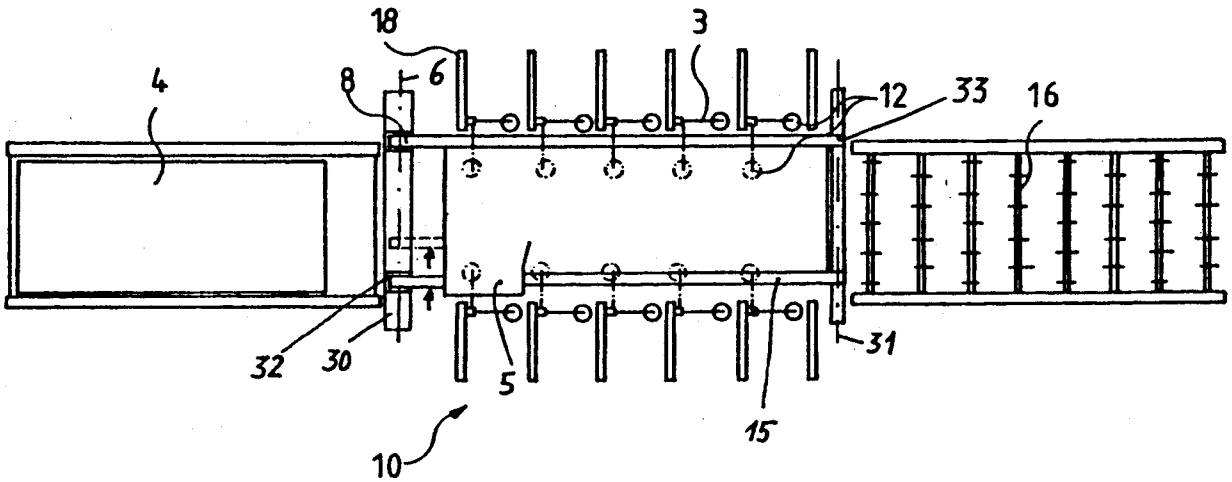
FIG. 2 is a schematic plan view of the installation according to FIG. 1.
Figure 3:
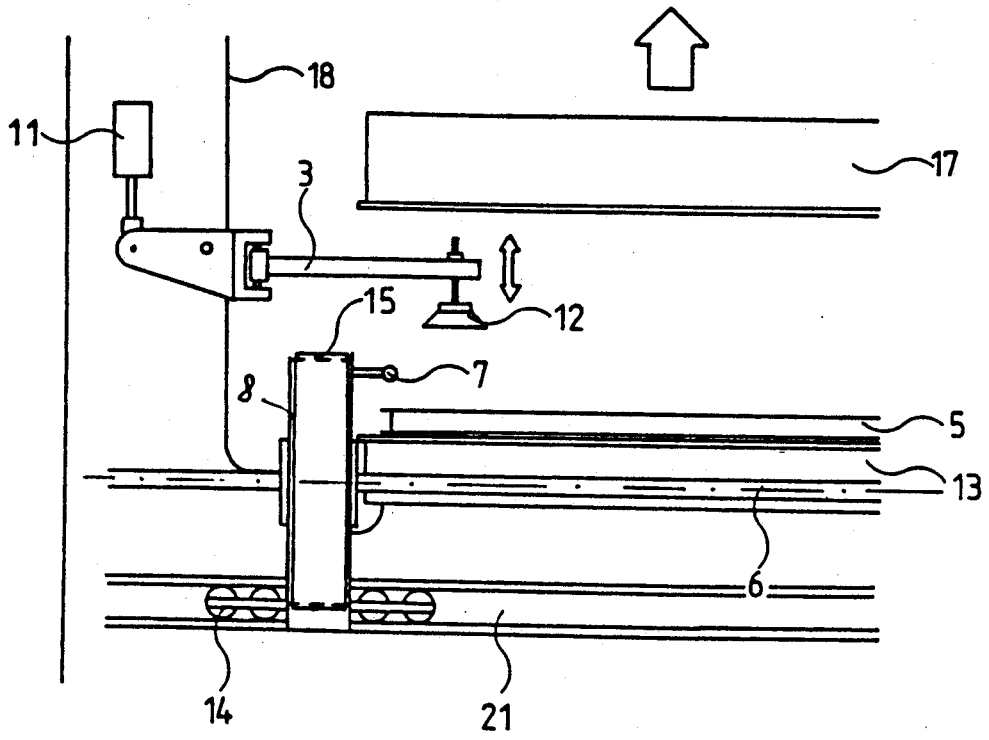
FIG. 3 is a partial view of the apparatus according to FIG. 1 in preparation for receiving a finished panel.
Figure 4:
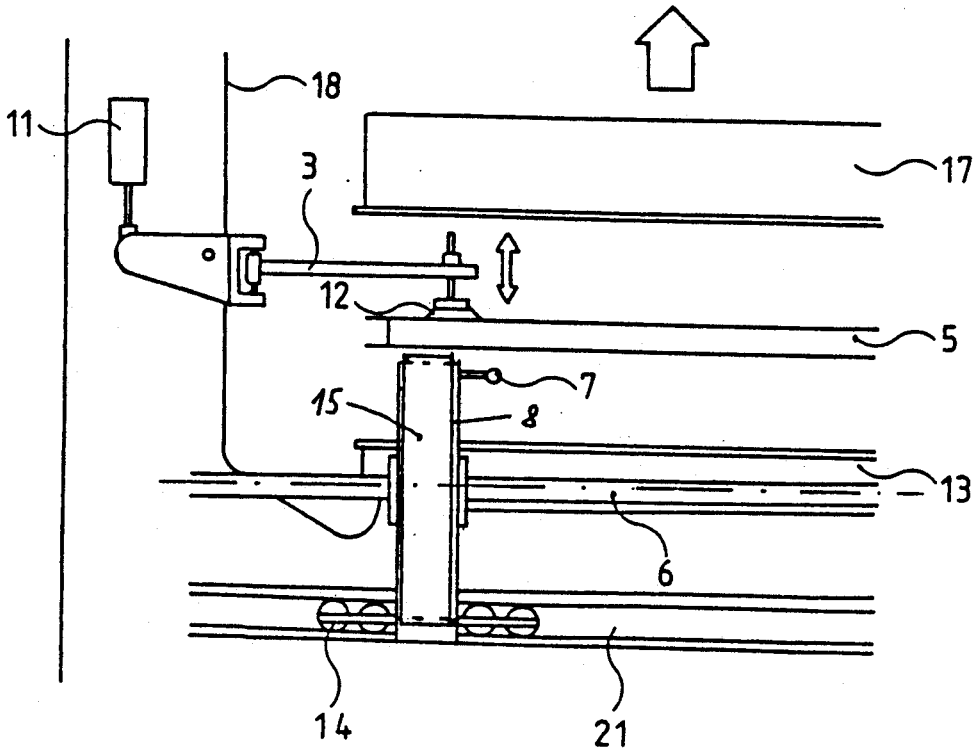
FIG. 4 is a partial view of the apparatus according to FIG. 3 during receiving and lifting of the panel.
Figure 5:
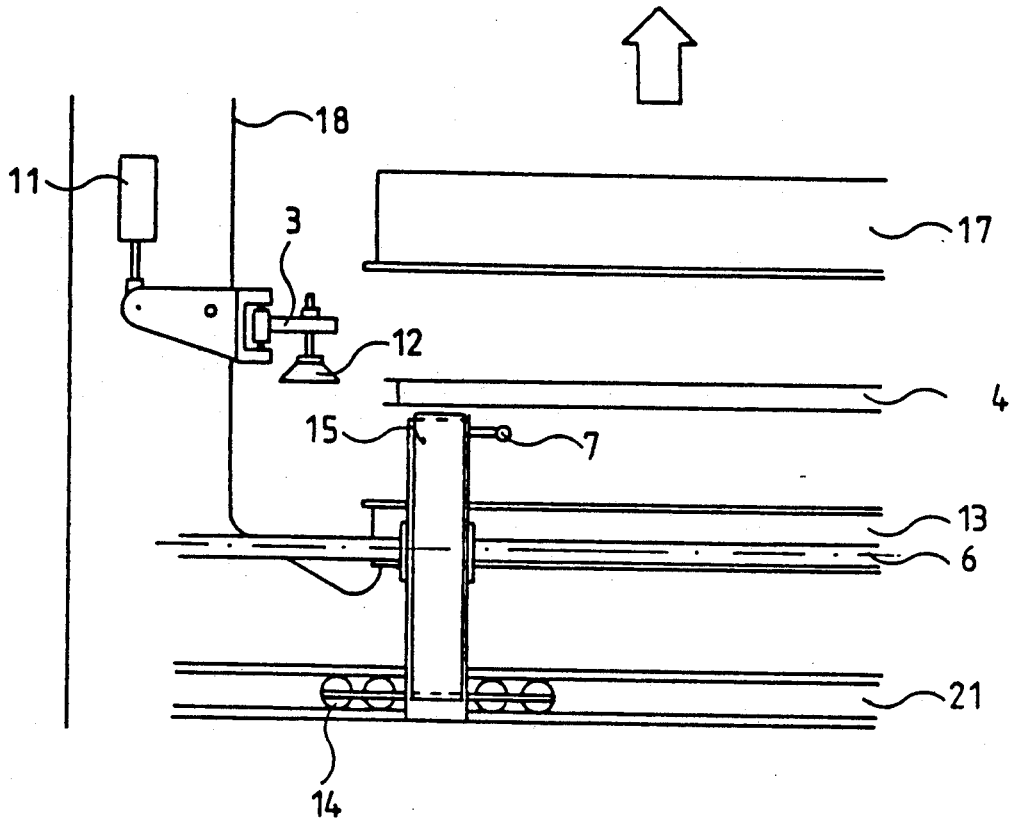
FIG. 5 is a partial view of the apparatus according to FIG. 3 during insertion of a laminated pack and during removal of the panel.
Figure 6:
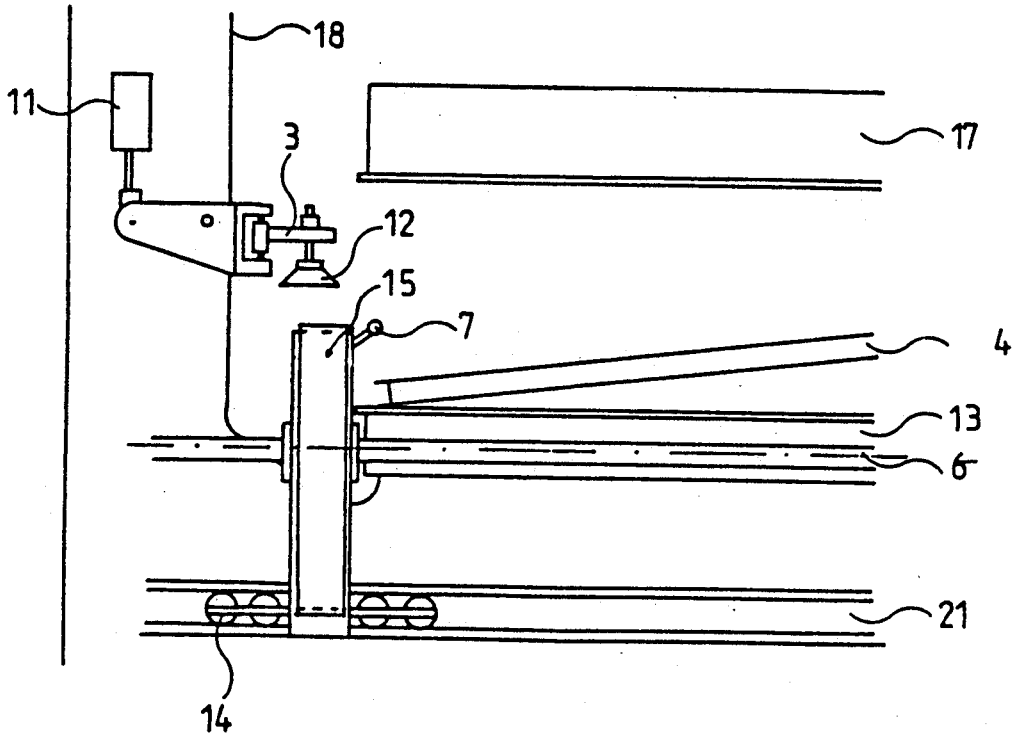
FIG. 6 is a partial view of the apparatus according to FIG. 3 during depositing of the laminated pack onto the press plate.
Figure 9:
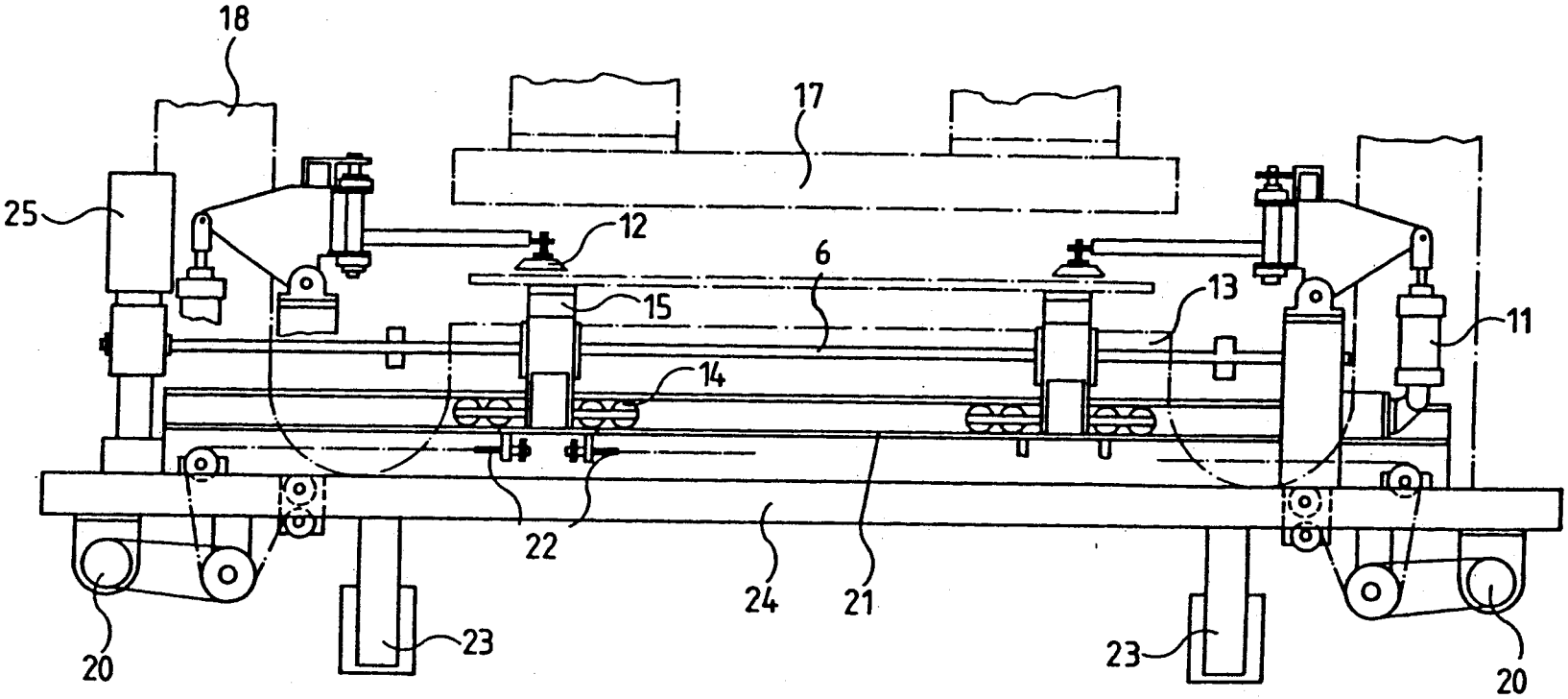
FIG. 9 is a front view of the apparatus with the splined shaft and the positioning and drive device.

Referring now to FIGS. 1, 2 and 9, insertion and removal of the laminated pack 4 and the finished panel 5 respectively into and from the press 10 progresses from left to right. Once the press 10 has been opened, the vacuum suction lifters 12, with the telescopic-like pivot arms 3 to facilitate horizontal adjustment of the lifters and accommodate different pressing widths, are swung from both longitudinal sides at right angles to the longitudinal direction of the press 10 into the press area (FIG. 3). Via lifting and lowering cylinders 11, the vacuum suction lifters 12 are now lowered onto the coated panel 5 (FIG. 4). The lifters 12 seize the panel 5, detach it from the press plate 13 and transfer it to the two rolling belt trays 8 moved into position on the splined shaft 6 from the left and right of the longitudinal sides by means of the positioning and drive device 30. An electric motor 25 sets the splined shaft 6 in rotation and the latter, via drive rollers 32 in rolling belt trays 8, sets the conveying belts 15 in motion. The conveying belts 15 move the finished panel 5 out of the press area onto the roller table 16, while the vacuum suction lifters 12 swing out of the press area (FIG. 5). During this step, the rolling belt trays 8 seize the laminated pack 4 set in motion by the rolling feed belt 9 and transport it into the press 10. To prevent slipping when the laminated pack is being accelerated and braked, they are also electrically ionized. When the move-out and insertion operation has ended, the laminated pack 4 is already lying on the rolling belt tray 8 in the depositing position (see FIG. 5). The positioning and drive device 30 now moves the rolling belt trays 8 into their initial position, which in the process deposit the laminated pack 4 in such a way that it rolls off over the rollers 7 onto the bottom press plate 13 (FIG. 6). The press 10 closes and the press operation starts.

Figure 7:
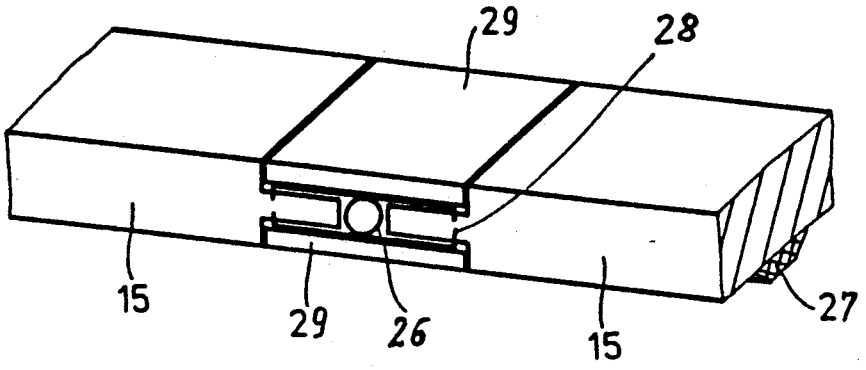
FIGS. 7 and 8 are perspective and side views, respectively, of the conveying belt with the hinge connection according to the present invention.
Figure 8:
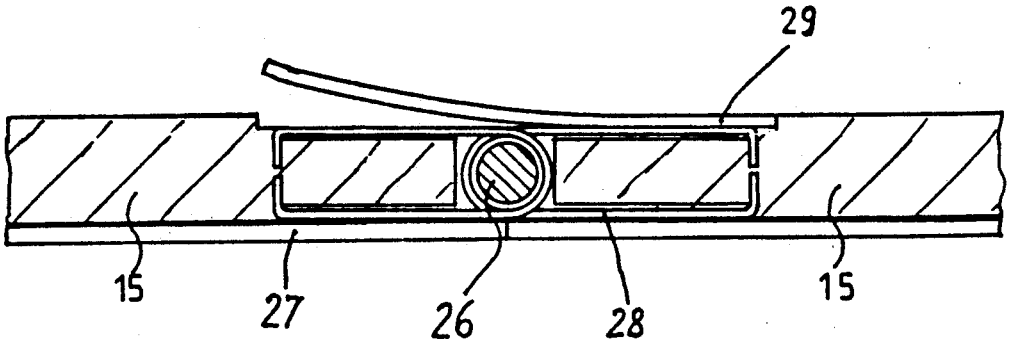

FIGS. 7 and 8 show a convenient design of a hinge 26 for connecting a conveying belt 15 to an endless belt for the rolling belt trays 8. The hinge 26 consists of spring clips 28 connecting the conveying belts 15 and is here protectively covered with a plastic lining 29, while the conveying belt 15 is provided with a rib 27 in the longitudinal center. The deflection pulleys 32 and 33 of the rolling belt trays 8 must of course be provided with a corresponding recess in the center for the rib 27.

The positioning and drive device 30 is fixed with its construction members on a beam 24, which in turn is mounted on foundations 23.

While specific embodiments of the invention have been described and illustrated, it will be clear that variations in the details of the embodiments specifically illustrated and described may be made without departing from the true spirit and scope of the invention as defined in the appended claims.

What is claimed is:

1. An apparats for inserting a laminated pack into a press area of a hot press having two longitudinal sides and for removing the laminated pack from the hot press, comprising:

a plurality of vacuum suction lifters disposed at the two longitudinal sides of the hot press;

said vacuum suction lifters being movable into and out of the press area;

a plurality of supporting devices disposed along the two longitudinal sides, said supporting devices being movable into and out of the press area;

said press lifters and support devices cooperating with each other so that the vacuum suction lifters, after the press has opened, move into a daylight opening of the press, lift a finished panel and deposit it onto the supporting devices, which have moved in below to receive the lifted panel, whereupon the supporting devices, as the finished panel is moved out, move into the daylight opening of the hot press to remove a new laminated pack from a supply means and deposit the pack onto a heating plate of the press by moving laterally out of the press area;

said vacuum suction lifters being extendable in a horizontally pivotable and vertically extendable manner;

said supporting devices comprising rolling belt trays for carrying conveying belts, the rolling belt trays being arranged longitudinally before and after the bottom heating plate;

first splined and second guide shafts extending over the press width for guiding said supporting devices;

drive pulleys arranged at an inlet end of the press cooperating with the rolling belt trays;

a positioning and drive means for moving said drive pulleys on said first, splined guide shaft at outer holding positions into variable center operating positions in the press area; and a motor for driving the first splined guide shaft and the drive pulleys, so that the conveying belts are rotationally movable via the drive and deflection pulleys.

2. The apparatus as claimed in claim 1, wherein the conveying belts of the rolling belt trays have a hinge connection covered with plastic in the core.

3. The apparatus as claimed in claim 1, wherein the conveying belts are constructed with guide ribs along the longitudinal center of each belt.

4. An apparatus for inserting a laminated pack into a press area of a hot press and for removing the laminated pack from the hot press, comprising:

a plurality of vacuum suction lifters which are horizontally pivotable extendable into and out of the press area;

a plurality of moveable support devices, each of which includes a rolling belt tray extending substantially parallel to a feeding direction of the hot press;

means, provided for each said suction lifter, for pivoting said lifter horizontally into the press area;

means for vertically raising and lowering said pivoting means, whereby said vacuum suction lifters are pivoted into the press area, vertically lift a laminated pack, and deposit the pack on said support devices;

a guide rail extending substantially in parallel with said guide shaft; and means for guiding the support devices into and out of the press area, said guide means comprising a guide shaft which extends over a press width of the press area and onto which the rolling belt trays are slideably mounted, and a plurality of support members which support the rolling belt trays and which are displaceably mounted in said guide rail.

5. The apparatus according to claim 4 wherein said guide means further comprises a second guide shaft which extends over the press width of the press area, and wherein at least one of said guide shafts is splined.

6. The apparatus according to claim 4 wherein said guide means further comprises a guide rail means in which said support devices may slide.

7. The apparatus according to claim 4 wherein said endless conveying belts are rotated via a plurality of drive and deflection pulleys.

8. The apparatus according to claim 7 wherein said guide shafts are driven by a motor to drive the drive pulleys.

9. The apparatus according to claim 5, further comprising a positioning and drive means to move the support devices into and out of the press area.

10. The apparatus according to claim 4 wherein the conveying belts of the rolling belt trays have at least one hinge connection.

11. The apparatus according to claim 10 wherein the hinge connection is covered with plastic in the core.

12. The apparatus according to claim 10 wherein the conveying belts are constructed with guide ribs along the longitudinal center of each belt.

* * * * *